US005285575A

United States Patent [19]

Hirano

[11] Patent Number: 5,285,575

[45] Date of Patent: Feb. 15, 1994

[54] CUTTER

[76] Inventor: Toru Hirano, 609, 3-1, Etchujima 1-chome, Koto-ku, Tokyo 135, Japan

[21] Appl. No.: 974,498

[22] Filed: Nov. 12, 1992

[30] Foreign Application Priority Data

Nov. 15, 1991 [JP] Japan ..... 3-327008

[51] Int. Cl.[5] ..... B67B 7/00

[52] U.S. Cl. ..... 30/2; 30/278; 30/DIG. 3

[58] Field of Search ..... 30/2, 278, 280, 282, 30/286, 289, 294, DIG. 3

[56] References Cited

U.S. PATENT DOCUMENTS 2,428,490 10/1947 Goughnour ..... 30/DIG. 3

3,068,569 12/1962 Campbell, Jr. ..... 30/294

3,430,339 3/1969 Hobson ..... 30/2

*Primary Examiner*—Richard K. Seidel

*Assistant Examiner*—Hwei-Siu Payer

*Attorney, Agent, or Firm*—Wenderoth, Lind & Ponack

[57] ABSTRACT

A cutter can rapidly and safely cut the edge of a variety of paper products and a variety of strings and other materials used for packaging. The cutter has a pair of holders laminated to each other, a pair of open-close bodies which are rotatably supported at edge portions of the holders, respectively and form a cutting area through which a paper product can be passed, and a cutting blade which is mounted to the edge portions of the holders and has a cutting edge protruding into the cutting area.

7 Claims, 7 Drawing Sheets

CUTTER

BACKGROUND OF THE INVENTION

1. Field of the Invention

This invention relates to a cutter, and more specifically, to a cutter which can efficiently open an envelope, cut the edge of a paper carton for milk, juice or other beverages, or that of a corrugated box or like member, and which can cut a variety of strings, tapes, and other materials used for packaging.

2. Description of the Related Art

Conventionally, as a means for cutting the edge of an envelope, a paper carton, and the like, or as a means for cutting strings, tapes, and other materials used for packaging, a knife and scissors are well known.

However, when a knife is used, for example, to cut the edge of an envelope, the cutting edge of the blade of the knife must be inserted inside the edge of the envelope. Thus, the envelope cannot be rapidly cut. In addition, the blade of the knife is exposed during the cutting operation. Thus, one's finger could be cut.

On the other hand, when a pair of scissors is used to cut the edge of an envelope or paper carton, the scissors must be opened and closed many times. Thus, the envelope cannot be rapidly cut.

Also when cutting various types of strings, tapes, and other materials which are used for packaging, the same problems as those state above are presented.

SUMMARY OF THE INVENTION

In consideration of the above-stated problem, an object of the invention is to provide a cutter which can rapidly and safely cut the edge of a variety of paper articles, and which can cut various types of string and other materials used for packaging.

The cutter of this invention has a pair of holders laminated to each other; a pair of open-close bodies which are rotatably supported at the edge portion of the holders and form the cutting area through which the portion of the workpiece, such as a piece of paper or overlapped or box-like member, to be cut can be passed; and a cutting blade which is mounted to the holders with a cutting edge thereof located in the cutting area.

The pair of holders include a pair of plates which are joined to the open-close bodies and which can be flexed to rotate the respective open-close bodies. Alternatively, the holder and the open-close bodies can be molded integrally.

In addition, a pair of holding-down pieces are provided on the pair of open-close bodies to center the article to be cut relative to the cutting blade.

A groove is defined between the holders and the open-close bodies where the cutting edge of the cutting blade is located, and into which groove string or other material can be inserted for cutting. A slider for chip removal is disposed in a recess extending into the holders from the vicinity of the cutting edge of the cutting blade. One end of the slider is near the cutting edge of the cutting blade and a finger applying protrusion is formed at the other end of the slider. The protrusion is exposed at the outer surface of one of the holders. Chips can be removed by sliding the slider in the groove.

In addition, a cutting blade replacing member has a small protrusion received in a small hole in the bottom of the cutting blade, and a push-button exposed at the outer surface of one of the holders. The small protrusion is moved down by depressing the push-button protrusion resulting in the small protrusion moving out of the small hole in the cutting blade.

A pair of magnets are mounted to the open-close bodies with the N and S poles of the magnets being opposed.

DETAILED DESCRIPTION OF THE INVENTION

Figure 1:
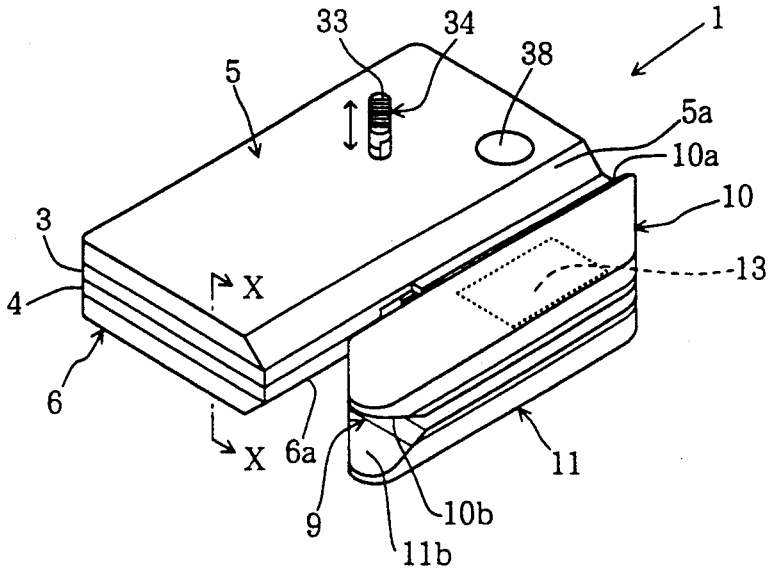
FIG. 1 is a perspective view of an embodiment of a cutter according to the present invention.
Figure 2:
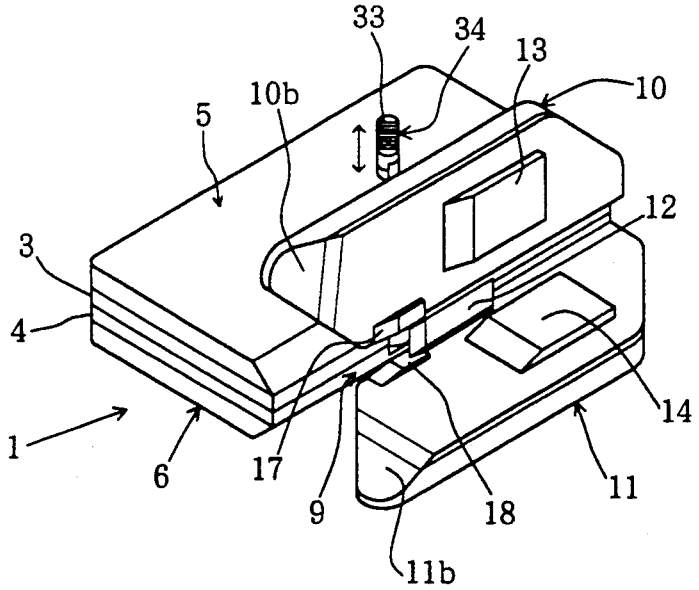
FIG. 2 is a perspective view of the same cutter when one of the open-close bodies is opened.

The cutter 1, as shown in FIGS. 1 to 5, is provided with a pair of holders 5 and 6 which include parallelepipedal main bodies made of plastic, and laminated to each other via a pair of thin plates 3 and 4 which are made of, for example, plastic. The thin plates 3 and 4 can bend at an appropriate location on the inner of the holders 5, 6. A pair of open-close bodies 10 and 11 are mounted to the holders 5 and 6 by being rotatably supported by the pair of plates 3 and 4. The open-close bodies 10 and 11 form a cutting area 9 through which the edge of an envelope 7, a paper carton 8 for containing a beverage, or other member to be cut can be passed. A cutting blade 12 is mounted at the edge portion of the holders 5 and 6 so that the cutting edge is in the cutting area 9.

The pair of plates 3 and 4 are joined to the holders 5, 6, respectively, with rivets 16 or other fasteners. One plate 3 can be flexed at the boundary between the holder 5 and the open-close body 10, while the other plate 4 can be flexed at the boundary between the holder 6 and the open-close body 11.

Alternatively, the pair of holders 5 and 6, open-close bodies 10 and 11, and plates 3 and 4 may be molded integrally. Also, a hinge mechanism can be provided at the boundary between the holders 5 and 6 and the open-close bodies 10 and 11 to rotatably support the open-close bodies 10 and 11, instead of the plates 3 and 4.

One holder 5 and open-close body 10 are provided with surfaces 5*a* and 10*a* chamfered at an angle of 45 deg or larger in the boundary area, respectively, so that the open-close body 10 can be rotated through a maximum angle of 90 deg or larger with respect to the holder 5.

The other holder 6 and open-close body 11 are also provided with the surfaces 6*a* and 11*a* chamfered at an angle of 45 deg or larger in the boundary area, respectively, so that the open-close body 11 can be rotated through a maximum angle of 90 deg or larger with respect to the holder 6.

Figure 3:
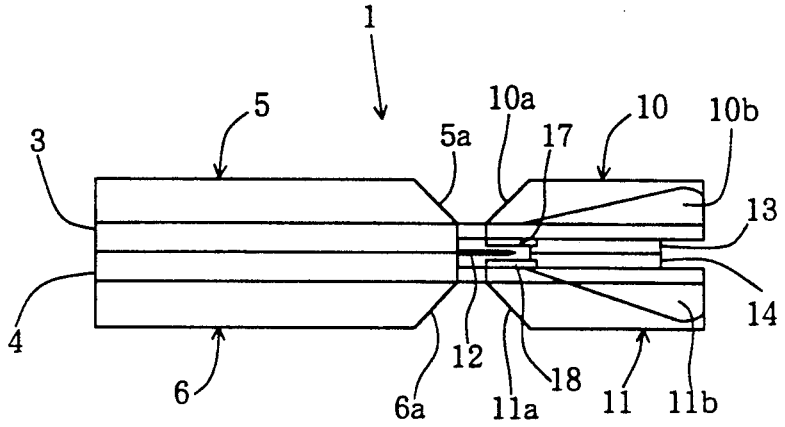
FIG. 3 is a side view of the same cutter.
Figure 4:
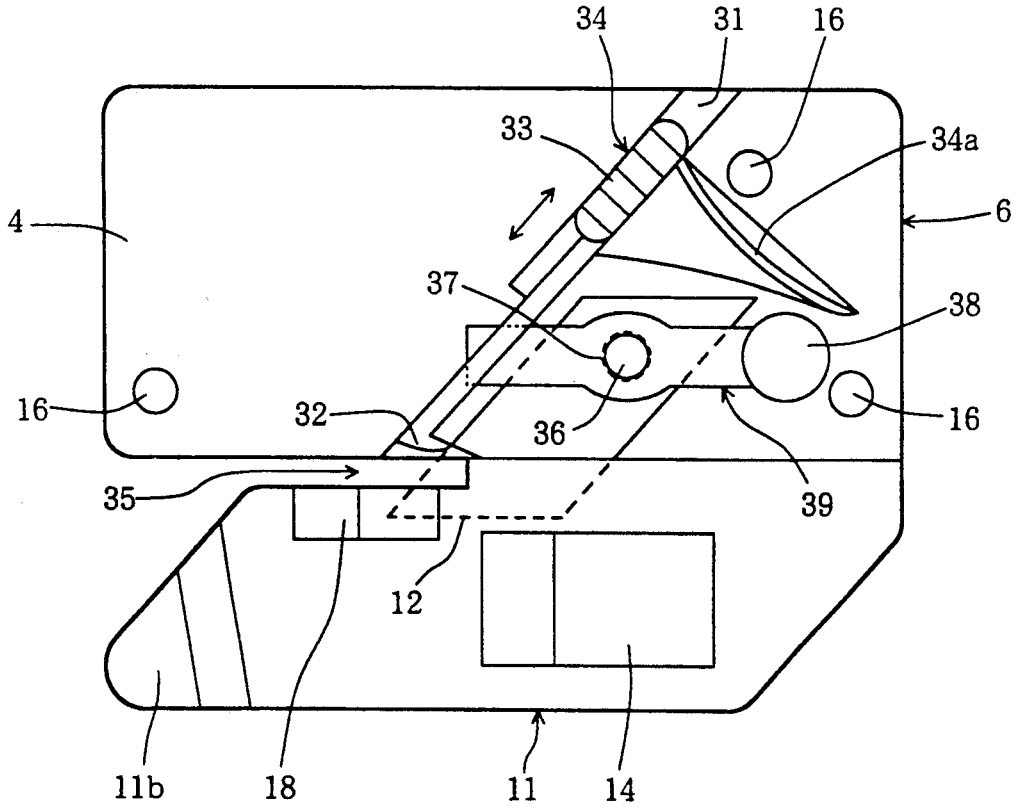
FIG. 4 is a plan view of the internal structure of the cutter, the plate 3 of the cutter being omitted.
Figure 5:
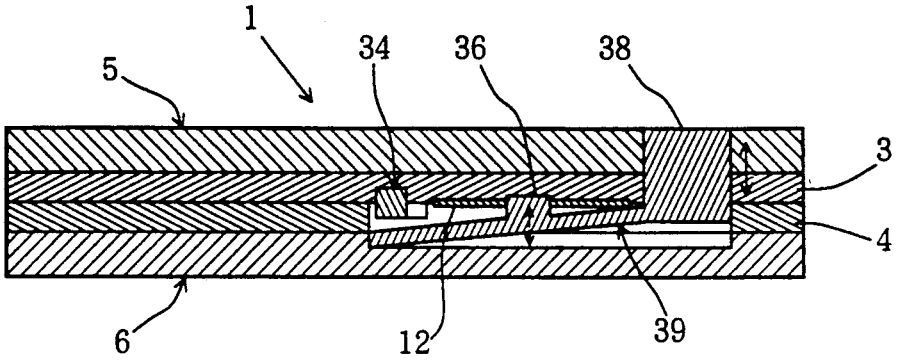
FIG. 5 is a sectional view taken along line X—X in FIG. 1.

Cutout portions 10*b* and 11*b* at respective ends of the open-close bodies, respectively, guide the envelope 7 or other member through the cutter. In addition, the open-close bodies 10 and 11 are provided with the holding-down pieces 17 and 18 to hold down the envelope 7 or other member at opposite positions. A slight clearance is maintained between the holding-down pieces 17 and 18 when the open-close bodies 10 and 11 are kept closed with a pair of magnets 13 and 14 attracting each other as shown in FIG. 3. The holding-down pieces 17 and 18 are convenient to center the envelope 7 or other workpiece when cutting the edge thereof, and to hold down the workpiece so that the cutting edge of the cutting blade 12 is positioned at the center with respect to the workpiece when the edge of a piece of paper or overlapped piece of paper is to be cut while the pair of open-close bodies 10 and 11 are closed.

The pair of magnets (permanent magnets) 13 and 14 is provided near the cutting area 9 with the N and S poles thereof being opposed. A recess 31 extends within the holders 5 and 6 from the vicinity of the cutting edge of the said cutting blade 12. A slider 34 for chip removal can be slid in this recess in the directions of the arrow in FIG. 4. One end 32 of the slider is near the cutting edge of the cutting blade 12, and a finger applying protrusion 33 formed at the other end of the slider is exposed at the outer surface of either one of the holders. Reference numeral 34*a* in FIG. 4 denotes a leaf spring which is provided to return the said slider 34 to its original position.

A groove portion 35, in which a workpiece string or other member can be inserted, is provided in the area between the holders 5 and 6 and the open-close bodies 10 and 11, where the cutting edge of the cutting blade 12 is located. A cutting blade replacing member 39, in the pair of holders 5 and 6, has a small protrusion 36 at one end received in a small hole 37 in the bottom of the cutting blade 12 and a push-button protrusion 38 at the other end exposed at the outer surface of one of the pair of holders 5 and 6. The small protrusion 36 is moved down by depressing the push-button protrusion 38 as shown with the arrows in FIG. 5, resulting in the small protrusion 36 being moved out of the small hole 37 in the cutting blade 12.

Now, the operation of the cutter 1 when the edge of a paper workpiece, such as an envelope 7, a paper carton 8 or other member, is cut will be described.

Figure 6:
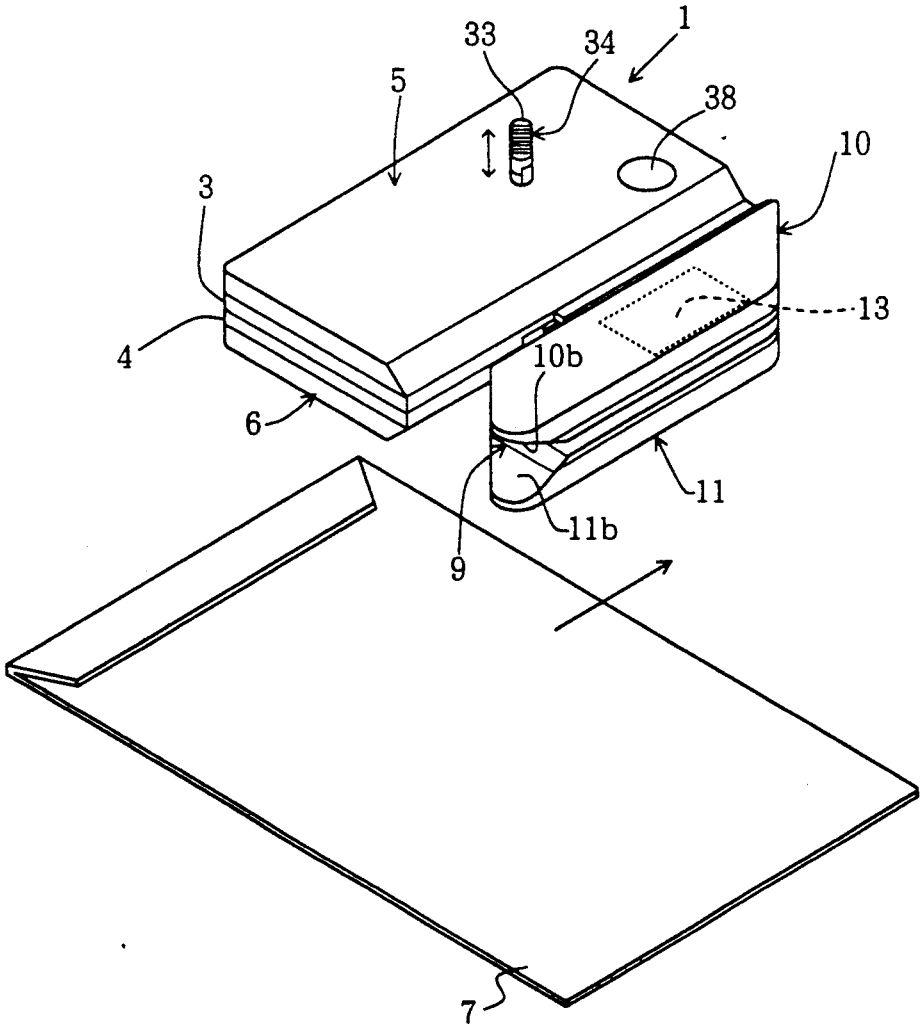
FIG. 6 is a perspective view illustrating how an edge of an envelope is to be cut with same cutter.
Figure 7:
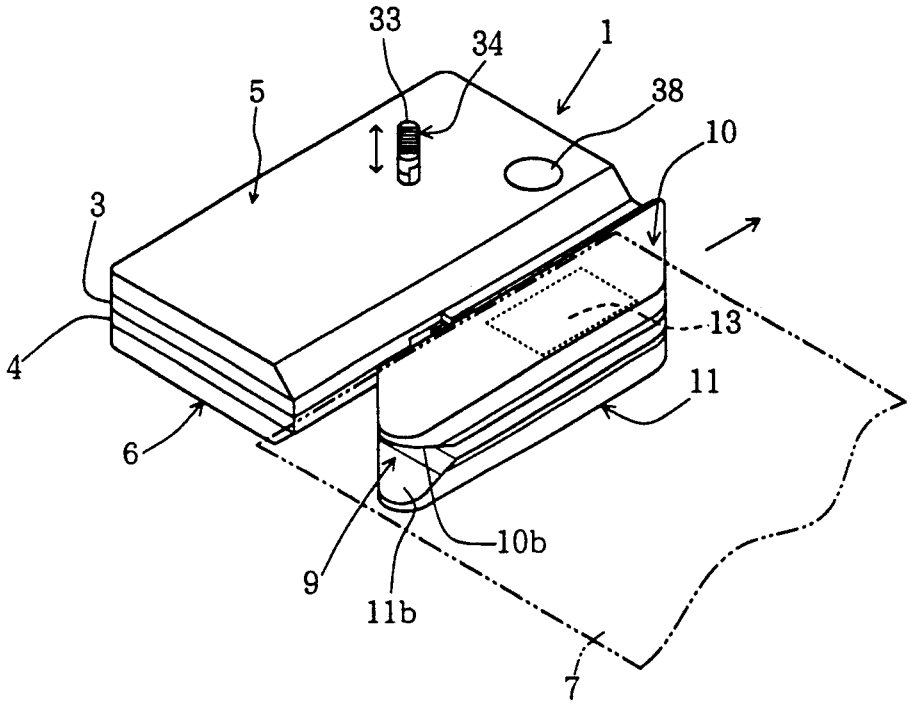
FIG. 7 is a similar view illustrating the edge of the envelope being cut with the cutter.
Figure 8:
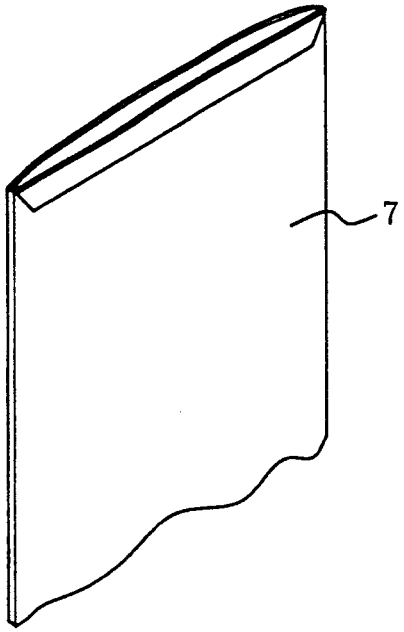
FIG. 8 is a perspective view of an envelope whose edge was cut with the cutter.

First, when cutting the edge of an envelope 7 or other piece of paper, the pair of open-close bodies 10 and 11 which are rotatably supported at the edges of the pair of holders 5 and 6 in this cutter 1, respectively, is closed to form a thin cutting area 9 corresponding to the shape of the envelope 7, as shown in FIG. 6. The edge of the envelope 7 is rapidly passed through the thin cutting area 9 formed by the pair of open-close bodies 10 and 11 in the direction of the arrow as shown in FIG. 7. In this operation, the edge of the envelope 7 is held down and centered by the holding-down pieces 17 and 18 at both sides of the envelope. Thus, the edge of the envelope 7 is moved accurately along the cutting blade 12 mounted at the edges of the holders 5 and 6, resulting in that the edge of the envelope 7 is continuously cut. Thus, the edge of the envelope is cut as shown in FIG. 8.

The slider 34 is slid in the groove 31 by urging the protrusion 33 with a finger toward the cutting edge of the cutting blade 12 to bring the end 32 of the slider 34 opposite the finger applying protrusion 33 to the outside of the holders 5 and 6, resulting in the chips produced during cutting and accumulated near the cutting edge of the cutting blade 12 being discharged to the outside of the holders 5 and 6.

Figure 9:
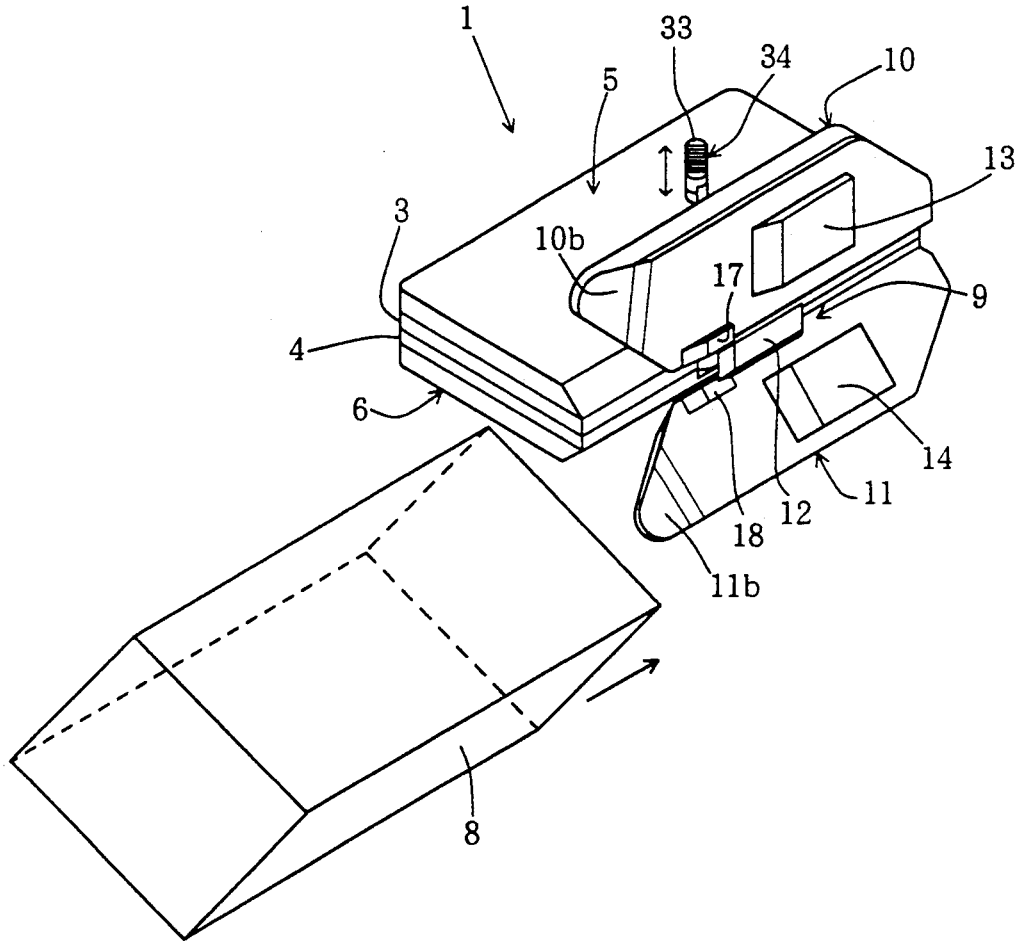
FIG. 9 is a perspective view illustrating how the corner of a paper carton is cut with the cutter.

Next, when cutting the corner of a paper box 8 or other member, the pair of open-close bodies 10 and 11 which are rotatably supported at the edges of the pair of holders 5 and 6 in this cutter 1, respectively, is opened to form an enlarged, open cutting area 9 corresponding to the shape of the paper box 8 to be cut, as shown in FIG. 9.

Figure 10:
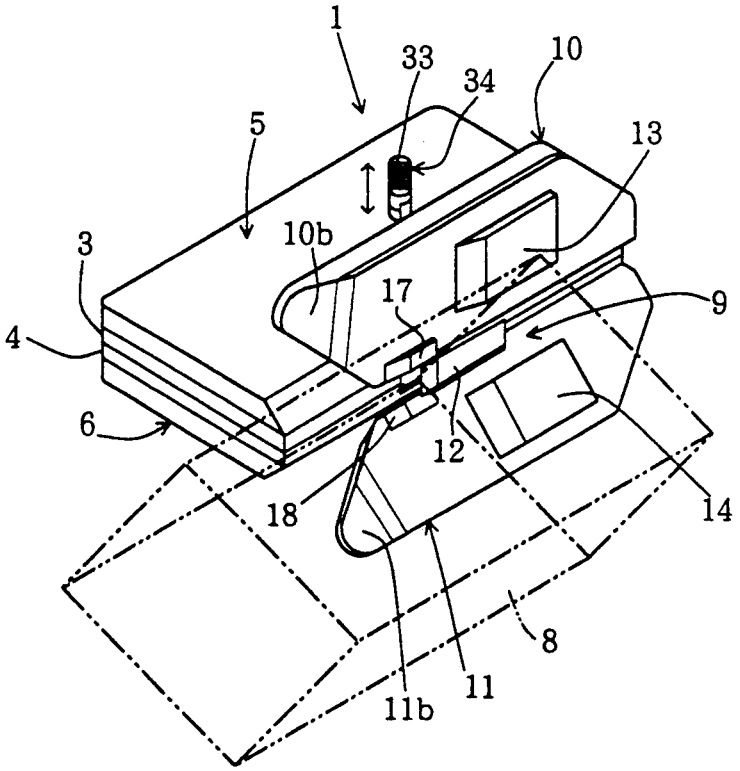
FIG. 10 is a similar view illustrating the corner of the paper carton being cut with the cutter.
Figure 11:
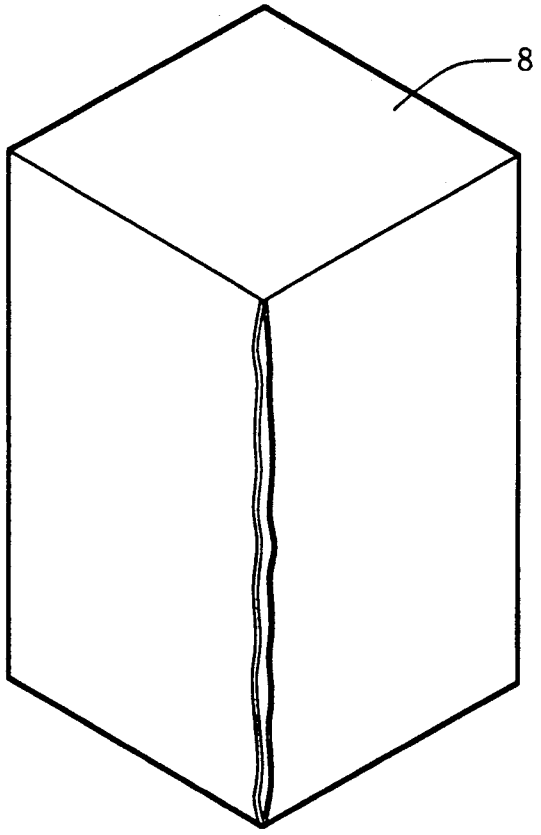
FIG. 11 is a perspective view of a paper carton whose edge was cut with the cutter.

Then, the corner of the paper box 8 that offers an angle of approximately 90 deg is rapidly passed along the cutting blade 12 which protrudes into the enlarged, open cutting area 9 as shown in FIG. 10. This results in the edge of the paper box 8 being continuously cut. Thus, the corner of the paper box 8 is cut as shown in FIG. 11.

By repeating such an operation on the corners of a paper box 8 or like member, the paper box 8 can then easily be flattened. The corners of a corrugated box can also be cut so that it can be flattened out in the same way as stated above.

When the cutter 1 of this embodiment is used to cut a variety of strings, tapes and other materials which are employed for packaging, such as those constituting a corrugated box, the open-close bodies 10 and 11 are fully opened. With the cutting blade exposed in this state, a string or other piece of material can be cut easily. A string or other piece of material can also be easily cut with the cutter 1 by inserting the string or the like into the groove portion 35 provided in the area between the holders 5 and 6 and the open-close bodies 10 and 11, and using the cutting edge of the cutting blade 12 that is located in the deepest area of the grooved portion 35.

Thus, the cutter 1 of this embodiment can rapidly and safely cut the edge of an envelope, a paper carton or like member, or can cut a string or other material with high efficiency.

The cutting blade replacing member 39 for use in replacement of the cutting blade 12 is provided inside of the pair of holders 5 and 6. Depressing the push-button protrusion 38 of the cutting blade replacing member 39 with one's finger moves the small protrusion 36 from the small hole 37 in the bottom of the cutting blade 12. Thus, the cutting blade 12 can be replaced in this state. Then, by releasing the push-button protrusion 38, the new cutting blade is secured in the holders.

When the cutter 1 is not in use, the pair of magnets 13 and 14 mounted to the open-close bodies near the cutting area are attracted to each other to fix the open-close bodies in a parallel arrangement, which makes the cutter 1 compact and safe.

This invention is not limited to the above-described embodiment, but various other embodiments within the scope of the claims will be readily apparent to those of ordinary skill in the art.

I claim:

1. A cutter comprising: a pair of superposed holders secured to one another; a pair of open-close bodies rotatably supported by said holders, respectively, at corresponding edges of said holders, said open-close bodies defining a cutting area therebetween through which an article to be cut can be passed; and a cutting blade mounted to said holders and extending into said cutting area from said corresponding edges of said holders.

2. A cutter as claimed in claim 1, wherein each of said holders includes a main body and a thin plate secured thereto, the thin plates being integral with said open-close bodies, respectively, and supporting the open-close bodies at said corresponding edges of said holders so as to be rotatable relative to the main bodies of the holders.

3. A cutter as claimed in claim 1, and further comprising holding-down members protruding from opposing surfaces of the open-close bodies, respectively, said holding-down members defining a gap therebetween when the open-close bodies are in a closed state, said cutting blade extending at a level corresponding to the center of said gap as taken between said holding-down members whereby said holding-down members center an article to be cut relative to the cutting blade when the open-close bodies are in the closed state and the article to be cut is passed through the cutting area.

4. A cutter as claimed in claim 1, wherein the cutter defines a groove between said open-close bodies and said holders, and said cutting blade is exposed at said groove whereby material to be cut can be inserted into the groove and cut by the cutting blade.

5. A cutter as claimed in claim 1, wherein said holders have a recess extending therein from the vicinity of an edge of said cutting blade, and further comprising a slider received in said recess, said slider having a first end near the edge of said cutting blade and a second end including a protrusion exposed at an outer surface of one of said holders, said slider being movable along said recess by applying pressure to said protrusion such that the first end of said slider can remove chips from an area adjacent the edge of said cutting blade.

6. A cutter as claimed in claim 1, wherein said cutting blade has a hold therein, and further comprising a cutting blade replacing member disposed in said holders, said cutting blade replacing member having a first end including a protrusion freely received in the hole in said cutting blade, and a second end including a push-button exposed at an outer surface of one of said holders, said protrusion moving out of said hole when said push-button is depressed.

7. A cutter as claimed in claim 1, and further comprising magnets mounted to said open-close bodies, respectively, an N-pole of one of said magnets opposing an S-pole of the other of said magnets when said open-close bodies are in a closed position.

* * * * *